US005391847A

United States Patent [19]

Gallone

[11] Patent Number: 5,391,847

[45] Date of Patent: Feb. 21, 1995

[54] INTERCONNECTING DEVICE BETWEEN CONTACTS IN ELECTRIC SWITCHES AND THE LIKE

[76] Inventor: Cesare Gallone, Via Milano 27, 20010 Cornaredo (MI), Italy

[21] Appl. No.: 93,469

[22] Filed: Jul. 19, 1993

[30] Foreign Application Priority Data

Feb. 26, 1993 [IT] Italy ..... MI93A000387

[51] Int. Cl.[6] ..... H01H 1/22

[52] U.S. Cl. ..... 200/244; 200/275; 200/558

[58] Field of Search ..... 200/244, 248, 275, 239, 200/558, 553, 458, 437, 438

[56] References Cited

U.S. PATENT DOCUMENTS

| | | | |
|---|---|---|---|
| 2,606,983 | 8/1952 | Rypinski | 200/248 X |
| 2,761,026 | 8/1956 | Youhouse | 200/553 X |
| 4,524,253 | 6/1985 | Sorenson | 200/438 |
| 4,737,602 | 4/1988 | Yamamoto | 200/275 X |
| 4,740,661 | 4/1988 | Nishikawa et al. | 200/244 X |
| 4,843,200 | 6/1989 | Parlatore et al. | 200/553 |

*Primary Examiner*—Renee S. Luebke

*Attorney, Agent, or Firm*—Kolisch, Hartwell, Dickinson, McCormack & Heuser

[57] ABSTRACT

In an electric switch, a movable contact element (6, 106) is linked to a first fixed contact (3, 103) by an end portion (14, 114) having a sharp-edge outline and housed in a seating having a rounded outline. The movable contact element (6, 106) has an interconnecting portion (9, 109) provided with a frusto-conical projection to be engaged in a coupling opening (18, 118) having rounded edges and formed in a second fixed contact (4, 114), so as to establish an electric continuity between the first and second fixed contacts when the movable contact element (6, 106) is brought to a closed condition. A first silver insert (16, 116) is joined on the interconnecting portion (9, 109), which insert has a larger volume than a second silver insert possibly joined on the edges of the coupling opening (18, 118). A protection cap (20, 120) arranged on the interconnecting portion (9, 109) receives the metal fragments projected from the contact area between said interconnecting portion and the second fixed contact (4, 104) following breaking and restoring of an electric continuity.

4 Claims, 3 Drawing Sheets

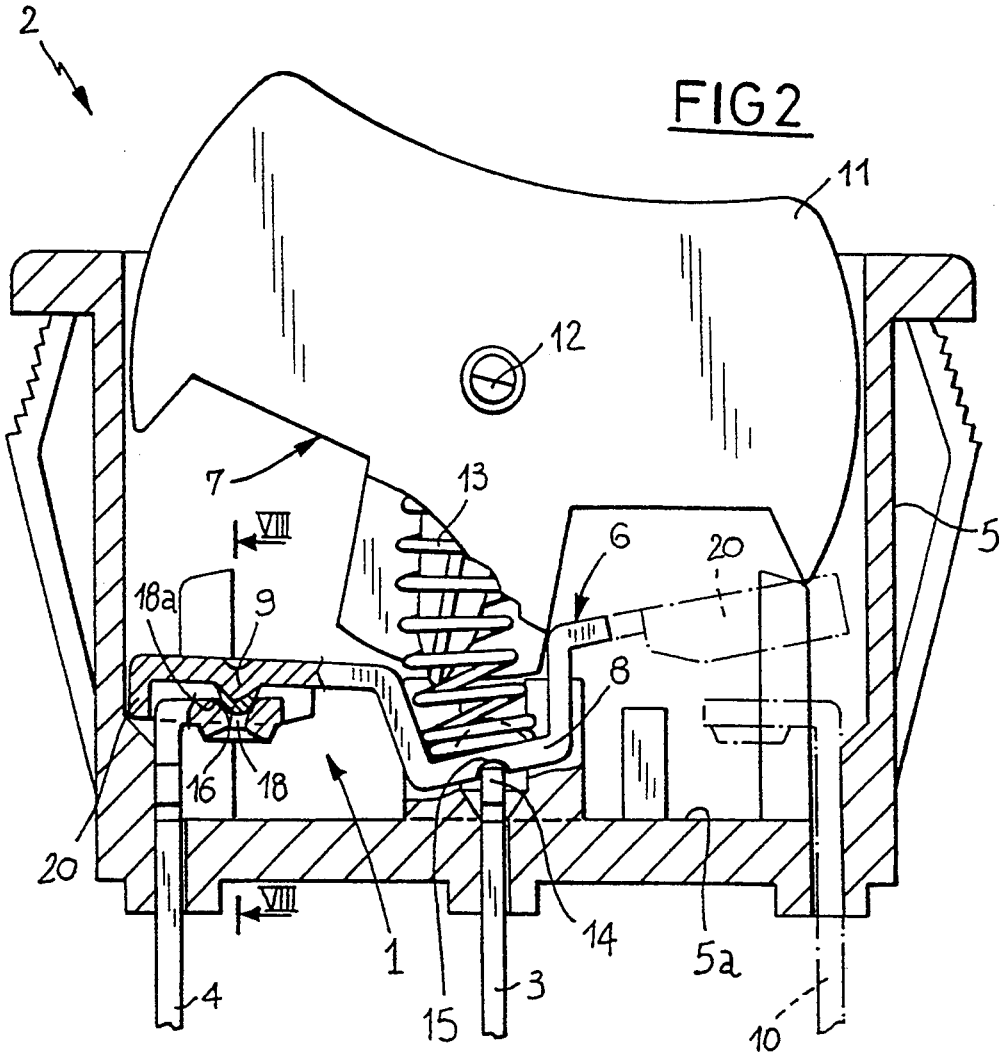
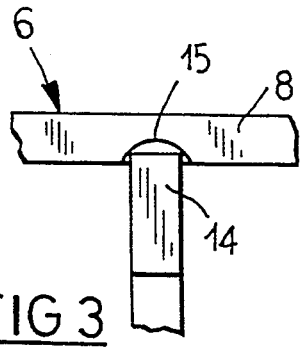
FIG 3
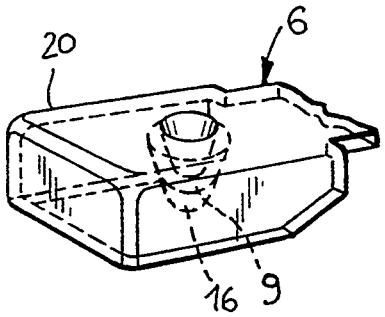
FIG 4

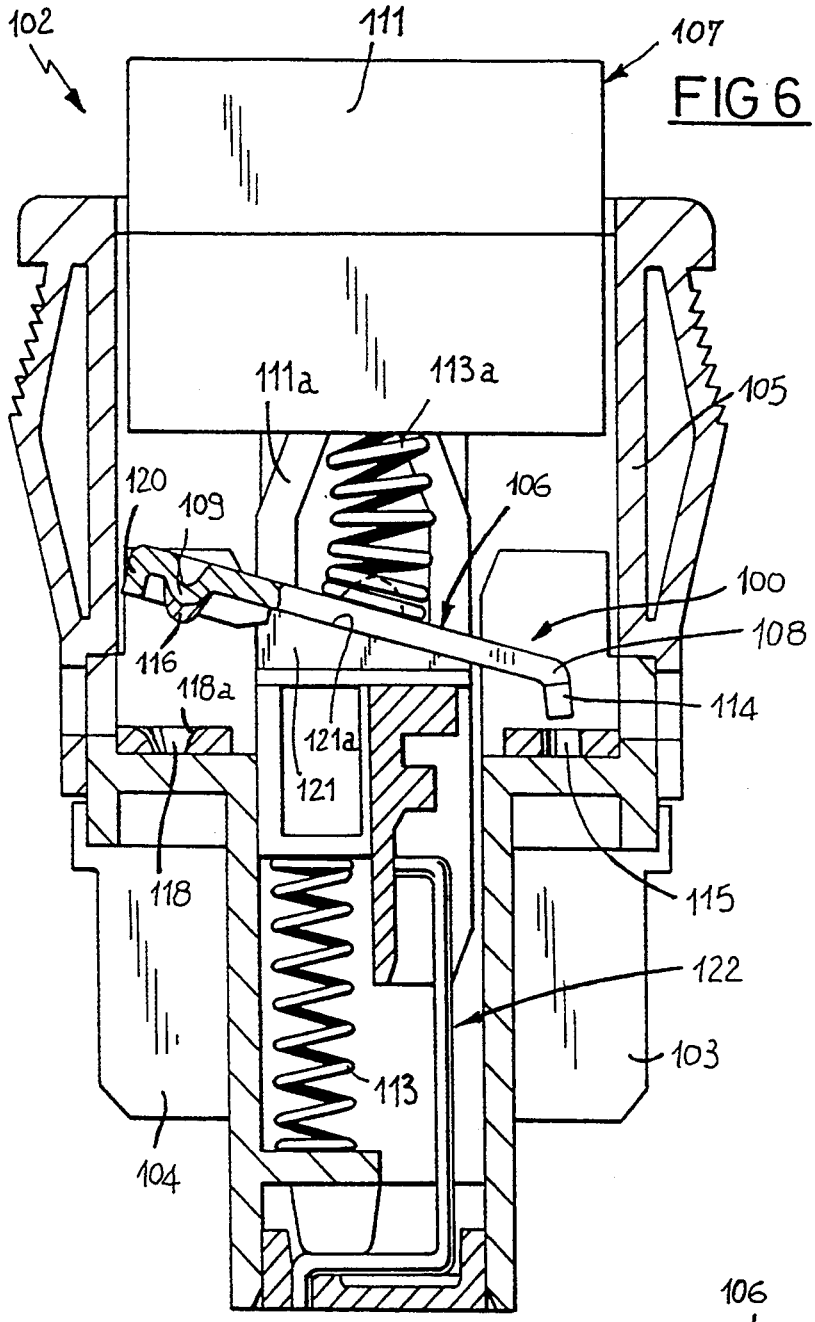
FIG 6
FIG 8
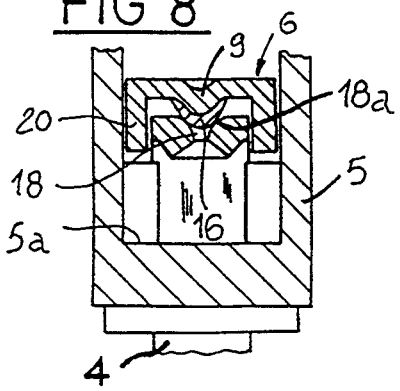
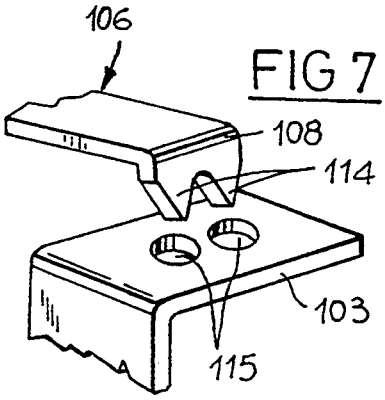
FIG 7

INTERCONNECTING DEVICE BETWEEN CONTACTS IN ELECTRIC SWITCHES AND THE LIKE

The present invention relates to an interconnecting device between contacts in electric switches and the like, of the type comprising: at least a first and a second fixed contacts electrically connected to first and second poles of an electric circuit, respectively; at least one movable contact element exhibiting a linking portion arranged to act oscillatably on the first fixed contact, and at least one interconnecting portion faced towards the second fixed contact; control means acting on the movable contact element to move it, by angular oscillation about the linking portion, between an opening condition in which said interconnecting portion is spaced apart from the second fixed contact and a closure condition in which the interconnecting portion operates in contact relationship against the second fixed contact in order to establish an electric continuity between the first and second fixed contacts.

In particular but not exclusively, the invention applies to electric switches or similar devices such as alternating current change-over switches, double-throw switches, etc. exhibiting relatively reduced sizes as they are intended for use mainly on household appliances and similar apparatus and designed to operate at current values that may reach 16 A at 250 V.

It is known that electric switches of the above type essentially comprise at least first and second fixed contacts rigidly supported by a casing made of plastic material and connected to respective poles of an electric circuit.

Housed in the plastics casing is a movable contact element that, through control means manually accessible from the outside of the casing, can be moved with alternate motion between at least one closure condition in which an electric continuity is established between the fixed contacts, and an open condition in which the electric continuity is broken.

In greater detail, the movable contact element is normally in engagement with the first fixed contact in an electric continuity relationship, while being capable of angular oscillation. This engagement is effected by a linking portion of rounded outline arranged on the first fixed contact or, alternatively, the movable contact element, operatively housed in a seating defined by a concavity of rounded outline exhibited by the movable contact element or, alternatively, the first fixed contact.

Practically, actuation and breakage of the current flow between the fixed contacts take place at the moment that an appropriate interconnecting portion carried by the movable contact element respectively touches and moves away from a corresponding rest seating arranged on the second fixed contact.

It is pointed out that in manufacturing switches particular expedients must be adopted so that, even after a prolonged use at strong current flows, their operational and safety features are not jeopardized.

In particular, any type of switch for being considered functional and safe must overcome given tests before being put on the market. The quality of the switch is evalutated at the end of a life test based on the maximum voltage, generally lower than 1500 V, applicable to the fixed contacts at an off position before an electric discharge between at least one of said fixed contacts and the movable contact element in the opening condition occurs. The functional operation of the switch is also evaluated depending on the maximum temperature detectable on the fixed contacts passed through by the maximum rated current at the end of a life test effected under given operating conditions.

It has been found that, at the present state of the art, many difficulties are encountered in making switches that, while maintaining a competitive price on the market, are also capable of overcoming any type of reliability test, so that they can be installed on mass-produced apparatus the marketing of which takes place worldwide.

For better explaining the above problems, it is pointed out that the critical points at which most of the phenomena tending to cause undesired temperature increases and promote the generation of voltaic arcs take place, are represented respectively by the areas at which the engagement between the movable contact element and the corresponding fixed contacts occurs.

The foregoing being stated, according to one of the expedients presently adopted for restraining the temperature increase at the engagement area between the movable contact element and the first fixed contact, coating layers made of silver are applied to the linking portion generally of rounded outline, and to the corresponding seating. The presence of silver increases the electric conductivity between the first fixed contact and the movable contact element and prevents the creation of scarcely electroconductive cupric oxide generated by a locally high temperature. In addition, silver causes a heating reduction by ohmic effect and an attenuation in the generation of flashings between the parts in relative sliding relation. The silver layers however, not only involve an important increase in the production costs of the switches, but are also subjected to a progressive wear which brings about a reduction (and in the long run the anulment) of their effects tending to restrain heating and flashings.

Still for the purpose of reducing heating by ohmic effect, in many cases a high thrust force is transmitted by the movable contact element to the first fixed contact by appropriate spring means. However this expedient increases the wear of the silver layers, if any, and in addition emphasizes the tendency of the movable contact element to rebound on the fixed contacts at the end of its displacement to the closed condition, which brings about the generation of voltaic arcs.

Also at the engagement areas between the first fixed contact and the movable contact element provision is made for the application of silver pads or added inserts of generally hemispherical conformation for increasing the electric conductivity and consequently reducing heating by ohmic effect.

Usually, the pad or insert applied to the interconnecting portion of the movable contact element has the same size as or is smaller than the one applied to the first fixed contact. It has been found however that under this situation, after the switch has been operated repeatedly, a much quicker wear of the silver pad or insert disposed on the movable contact element occurs than of the one disposed on the fixed contact.

The applicant has found this phenomenon to be mainly due to the fact that heat produced by ohmic effect is dissipated in a relatively easy manner by the fixed contact through the conductors connected thereto, whereas, on the contrary, heat transferred to the movable contact element is hardly dissipated and causes an important local increase of temperature on the movable contact element itself. The temperature increase promotes silver sublimation during the unavoidable generation of the voltaic arc in the contact opening and closure steps, thereby bringing about the early wear of the added silver insert. Part of the vaporized silver condensates on the colder fixed contact.

In addition, the generation of metal vapors resulting from silver sublimation further promotes the formation of the voltaic arc, which in turn increases the above negative effects, that is temperature raising and insert wear.

The applicant has also ascertained another cause for the problems encountered in known switches, represented by the fact that the movable contact element is not guided in a sufficiently precise manner in its movements.

In the connection it is to note that the voltaic arcs inevitably produced between the interconnecting portion of the movable contact element and the respective fixed contact cause the deposition of a slight metal oxide layer on the surfaces of the silver inserts.

This deposition takes place around the point where the actual physical contact between the added silver inserts occurs, and therefore a very restrained area including the contact point itself remains automatically clean.

However, for the above reasons the point of real physical contact of the added silver inserts never keeps a well-defined position, but slightly moves in turn, as the switch is turned on and off repeatedly. As a result the contact point will always fall on the oxide layer deposited on the occasion of the preceding turning on and off of the switch.

Clearly, this situation leads to a worsening of the electric conduction and further promotes the generation of voltaic arcs, raising of temperature and wear of the silver added inserts.

The generation of the voltaic arcs also causes the projection of small metal fragments in the form of droplets, that deposit on the inner walls of the plastics casing. The presence of these deposited metal fragments greatly reduces the insulating power of the casing and, above all in small-sized switches, can make them unfit when the insulation test is carried out at the end of the life test.

The main object of the present invention is substantially to solve all the problems cited above with reference to the known art, by providing an interconnecting device between contacts in switches and the like that, by virtue of particular expedients, enables an important reduction in the voltaic arcs as well as in the temperatures generated on the contact elements while, at the same time, being feasible at very reduced costs.

The foregoing and further objects that will become more apparent in the course of the present description are substantially achieved by an interconnecting device between contacts in electric switches and the like, characterized in that the first fixed contact and the linking portion mutually engage by at least one end portion having a sharp-edge outline and operating in at least one seating of rounded outline.

Further features and advantages will best be understood from the detailed description of some preferred embodiments of an interconnecting device between contacts in electric switches and the like, in accordance with the present invention, given hereinafter by way of non-limiting example with reference to the accompanying drawings, in which:

FIG. 2 is a sectional side view of the switch shown in FIG. 1;

FIG. 3 shows to an enlarged scale, a detail emphasizing the engagement between the movable contact element and the first fixed contact in the switch represented in FIGS. 1 and 2;

FIG. 4 is a enlarged perspective view showing a protective cap that may be provided the movable contact element;

FIG. 6 is a sectional view of the switch shown in FIG. 5;

FIG. 7 is an enlarged perspective view emphasizing the engagement between the movable contact element and the first fixed contact in the embodiment seen in FIGS. 5 and 6;

FIG. 8 is a part sectional view taken along line VIII—VIII in FIG. 2.

Figures 1, 5:
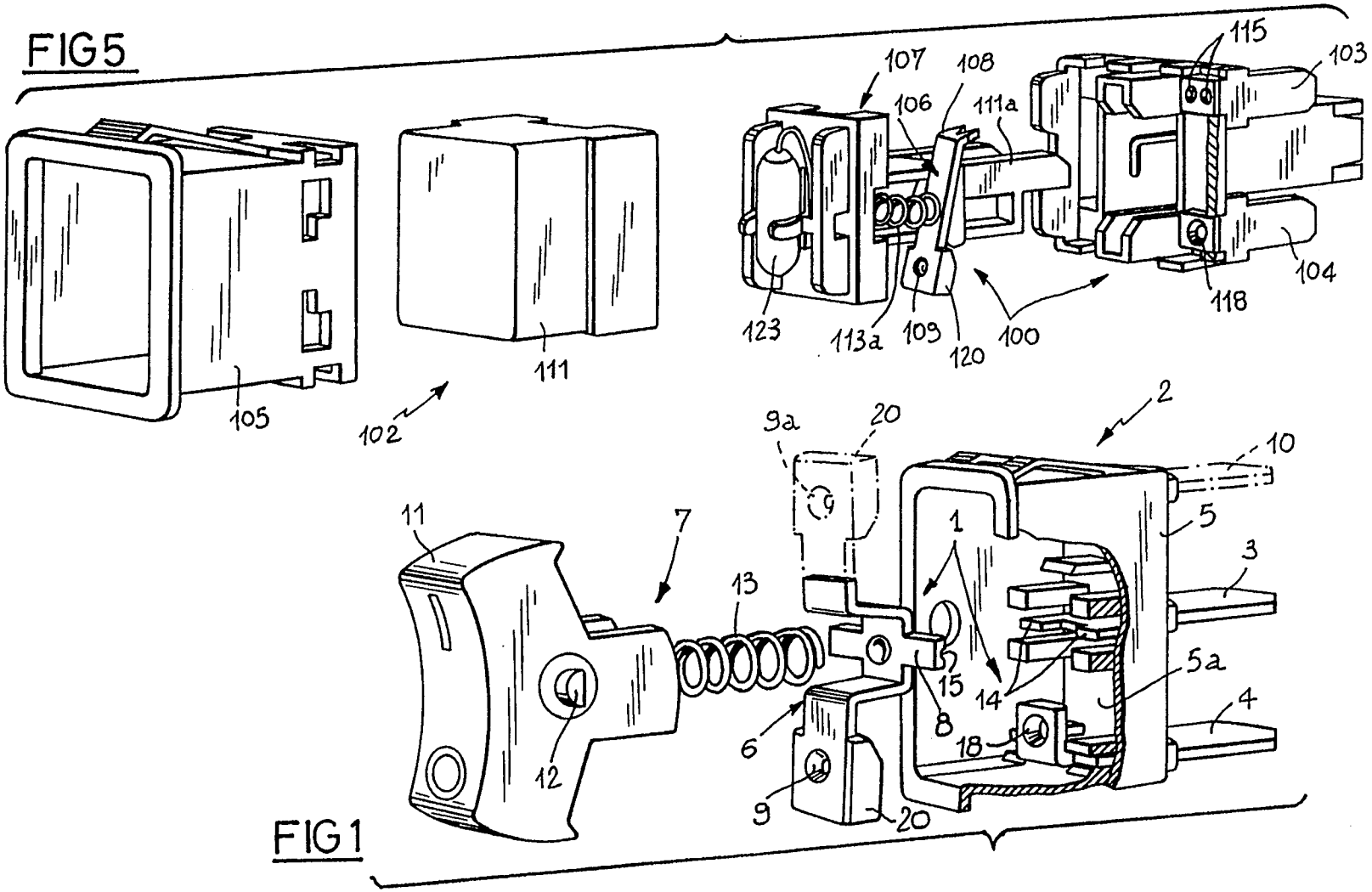
FIG. 1 is a part interrupted perspective and exploded view of a switch incorporating an interconnecting device according to one embodiment of the present invention.
FIG. 5 is a part interrupted perspective and exploded view of a second switch incorporating an interconnecting device made in accordance with a second embodiment of the invention.

Referring to FIGS. 1 to 4 and 5 to 7 respectively, two embodiments of an interconnecting device between contacts in electric switches and the like in accordance with the present invention have been generally identified by reference numerals 1 and 100 respectively.

In the embodiment seen in FIGS. 1 to 4, the device 1, embodied in a switch 2, comprises at least first and second fixed contacts 3, 4, operatively fastened to the base 5a of a casing 5 made of insulating material.

The fixed contacts 3, 4, respectively, connected to a first end and a second end (not shown ass known and conventional) of an electric circuit, cooperate with at least one movable contact element 6 capable of alternate motion between an open condition and a closed condition for respectively breaking and enabling an electric continuity between the fixed contacts themselves.

In particular, the movable contact element 6 has at least one linking portion 8 oscillatably engaged on the first fixed contact 3, as well as an interconnecting portion 9 adapted to be moved close to and away from the second fixed contact 4 when the movable contact element is brought to the closed condition and moved to the open condition, respectively.

As shown by dotted line in FIGS. 1 and 2, an auxiliary interconnecting portion **9*a* may be arranged on the movable contact element 6 on the opposite side with respect to the interconnecting portion 9. The auxiliary interconnecting portion 9*a* cooperates with a third fixed contact 10 in order to open and close another electric circuit following a reverse modality with respect to the circuit extending between the first and second fixed contacts 3 and 4. In this case the switch 2** performs the function of a double-throw switch.

The control means 7 designed to move the movable contact element 6 between open and closed conditions, in the described example comprises a rocker pushbutton 11 pivotally mounted in the casing 5 by at least one pivot pin 12 and operatively engaging a bistable helical spring 13 engaging linking portion 8 of the movable contact element itself. In known manner, the bistable spring 13 alternately bends on opposite sides with respect to an ideal median line for selectively keeping the movable contact element 6 in an open or closed condition upon command of the rocker pushbutton 11. The bistable spring 13 in turn ensures a constant contact pressure by the linking portion 8 on the end of the first fixed contact 3.

According to the present invention, the first fixed contact 3 and the linking portion 8 are advantageously provided to be mutually engaged by one or more end portions 14 having a sharp edge outline and acting in at least one corresponding seating 15 of rounded outline. In greater detail, in the example shown in FIGS. 1 to 4, the sharp-edge end portions 14 are joined on the end of the first fixed contact 3, whereas the seatings 15 of rounded outline are formed in the linking portion 8 associated with the movable contact element 6.

Advantageously the high specific contact pressure that is consequently created between the sharp edges of the end portions 14 and the seatings 15 ensures a constant electric continuity and a low contact resistance between the first fixed contact 3 and the movable contact element 6, without the application of silver at the areas of mutual engagement between said contacts being to this end required.

For restraining wear between the linking portion 8 and the end portions 14, it is preferable that the end portions should have high hardness, higher than the hardness of the linking portion 8. This can be achieved for example by carrying out a surface hardening process on the end portions 14 of the fixed contact 3. This solution enables the wear of the edges in the end portions 14 as a result of their sliding on the seating of rounded outline 15 to be conveniently restrained.

The application of an appropriate conductive soap grease of known and conventional type may also be provided at the seating 15 of rounded outline, so as to enable wear to be further reduced.

It is also to be noted that the connection produced by the sharp-edge end portions 14 and the corresponding seatings of rounded outline 15 reduces the generation of voltaic arcs, even between the interconnecting portion 9 of the movable contact element 6 and the second fixed contact 4.

The high specific pressure achieved makes it possible to advantageously reduce the force exerted by the bistable spring 13, as compared to known constructions, thereby restraining the undesired generation of voltaic arcs due to the rebounding effects undergone by the movable contact element 6 on passing between open and closed conditions.

In addition, the connection between the movable contact element 6 and the first fixed contact 3 carried out in accordance with the invention causes the movable contact element 6 to be guided in a very precise manner during its displacements between open and closed conditions. It is thus ensured that the physical contact between the interconnecting portion 9 and the second fixed contact 4 will take place at one or more points, the location of which is well-determined and not subjected to continuous changes as the switch 2 is repeatedly turned on and off, as happens in the known art.

The point or points of physical contact will be automatically maintained clean by effect of the voltaic arcs inevitably generated when the interconnecting portion 9 moves close to and away from the second fixed contact 4, in that the oxides produced by time voltaic arcs always lay down around the actual physical contact point, but never exactly at said point.

In order to ensure a greater electric continuity between the second fixed contact 4 and the movable contact element 6 in the closed condition, it is preferably provided that on the interconnecting portion 9 at least one silver insert or pad be joined, which is adapted to directly act on the second fixed contact 4 for establishing the desired electric continuity. In addition, a second silver insert (not shown) may also be arranged on the second fixed contact 4, said insert being designed to contact with the first silver insert 16.

In accordance with the invention however, the first silver insert 16 has a volume (or silver material amount) higher than the second silver insert. This expedient enables the silver consumption to be optimized by effect of the voltaic arcs generated between the movable contact element 6 and second fixed contact 4. In fact, the maximum amount of silver is arranged just on the regions (that is the interconnecting portion 9) where the maximum temperature values are reached.

A silver-free surface or a surface having a reduced amount of silver is used on the regions (that is the second fixed contact 4) where the temperature raising and the consequent sublimation of the material, are restricted by effect of the heat dissipation through the electric conductors connected to the fixed contact itself. As above mentioned, part of the silver material vaporized by sublimation will be deposited on the colder surfaces of the second fixed contact 4.

In order to further restrain the sublimation of metal materials by effect of the high localized temperatures produced by the voltaic arcs, it is also provided that the interconnecting portion 9 together with the first insert 16 added thereto, if any, should be in the form of a projection having a tapering outline, substantially of frusto-conical configuration with a rounded vertex. The interconnecting portion 9 is adapted to be coaxially inserted in a coupling opening 18 defined in the second fixed contact 4, so as to act, as shown in FIG. 2, against the perimetric edge **18*a*** advantageously having a rounded outline, exhibited by the coupling opening itself.

The voltaic arc produced when the interconnecting portion 9 moves close to or away from the second fixed contact 4 undergoes a progressive displacement with the displacement of the interconnecting portion itself, on the extension of the perimetric edge **18*a* of the coupling opening 18 and on the outer surfaces of the interconnecting portion. The progressive displacement of the voltaic arc eliminates or greatly reduces the generation of high temperatures localized on the interconnecting portion 9 and/or the second fixed contact 4, which results in a reduction of the metal material sublimation. Therefore, the amount of silver necessary to form the first silver insert 16 or the second silver insert (if any) joined on the second fixed contact 4, can be further reduced. In particular, the second added insert may consist of a mere plating formed on the edge 18*a* of the coupling opening 18**.

In accordance with a further feature of the invention, at least one protection cap 20 may be advantageously associated with the movable contact element 6, which cap, as clearly shown in FIG. 4, encloses the interconnecting portion 9 at least partly.

When the movable contact element 6 is in the vicinity of the closed position, the protection cap 20 encloses under it the engagement area between the interconnecting portion 9 and the second fixed contact 4. Under this situation, the protection cap 20 advantageously receives the possible projections of metal vapors from said engagement area as a result of the generation of voltaic arcs. Thus the risk that the fused metal particles by depositing and/or condensing on the inner walls of the casing 5 may reduce the insulating capability of the casing itself is eliminated, which means that short-circuiting of the fixed contacts 3, 4 when the movable contact element 6 is in the opening condition is not promoted.

Referring now to FIGS. 5 to 7 in particular, the device 100 therein shown is inserted in a corresponding switch 102 having a pushbutton 111 of the sliding type.

For the sake of clarity the individual components in the switch 102 shown in said figures are identified by the same reference numerals used in FIGS. 1 to 4, increased by 100.

In this case too, the switch 102 has at least a first and a second fixed contacts 103, 104 rigidly engaged to a casing 105 of electrically insulating material and respectively connected to the opposite poles of an electric circuit. At least one movable contact element 106 is mounted within the casing 105 and, upon the action of control means 107 operable from the outside of the casing 105, can be moved between an open position and a closed position, in the same manner as described with reference to the embodiment previously illustrated.

The control means 107 comprises a pushbutton 111 slidably engaged in the casing 105 and projecting externally of the same. The pushbutton 111 is engaged to a slider 111*a* movable within the casing 105, against the action exerted by a helical return spring 113.

Associated with the pushbutton 111 is at least one preloading spring 113*a* acting on the movable contact element 106 so that the latter, in the open condition, is kept against a rest surface 121*a* defined by a locating lug 121 carried by the slider itself.

A linking portion 108 is provided at one end of the movable contact element 106 and, as a result of the lowering of the slider 111*a* with reference to FIG. 6, the linking portion oscillatably engages with the first fixed contact 103. Through a further lowering of the slider 111*a*, separation of the rest surface 121*a* from the movable contact element 106 is caused, so that the movable contact element retained at the linking portion 108 on the first fixed contact 103, takes the closed condition bringing an interconnecting portion 109 thereof into engagement with the second fixed contact 104.

The amount of the force exerted by the linking portion 108 and interconnecting portion 109 on their acting on the fixed contacts 103, 104 is determined by the action, of the preloading spring 113*a*.

A device generally identified by 122 and not described in detail as known and conventional, acts between the casing 105 and slider 111*a* for retaining the latter against the action of the return spring 113 when the movable contact element 106 must keep the closed condition. Following a thrust action manually exerted on the pushbutton 111, device 122 releases the slider 111*a* so that the movable contact element 106 is brought back to the opening condition.

In FIG. 5, 123 denotes a lamp that, in known manner and therefore not further described, lights the pushbutton 111 when the contact element 106 is in the closed condition, in order to signal the electric continuity state between the fixed contacts 103, 104.

In accordance with the present invention, the device 100 is substantially provided with all technical expedients described with reference to FIGS. 1 to 4. However, unlike the embodiment depicted in the last mentioned figures, one or more end portions having a sharp-edge outline 114 are formed on the linking portion 108 of the movable contact element 106 instead of on the end of the first fixed contact 103. Explaining in greater detail, the end portions 114 are substantially made in the form of wedge-shaped projections and are designed to be fitted in corresponding circular openings formed in the first fixed contact 103 and each defining a corresponding seating 115 of rounded outline.

Therefore, this solution also as does the one described with reference to FIGS. 1 to 4, enables high specific contact pressures to be generated between the linking portion 108 and the first fixed contact 103, as well as a precise positioning of the movable contact element 106 during the displacement to the closed condition.

In this case also the material forming the end portions 114 can be given a hardness higher than that of the material forming the rounded-outline edges by an appropriate surface hardening process, and the use of an appropriate conductive soap grease can be provided for reducing frictions and dispersing heat produced by ohmic effect.

In the same manner as described with reference to FIGS. 1 to 4, provision may also be made for the application of a first added silver insert 116 to the interconnecting portion 109 of truncated conical form with a rounded vertex or any other tapering configuration. A second added silver insert, not shown, may be applied, optionally in the form of a plating, to a rounded edge 118*a* of a coupling opening 118 formed on the second fixed contact 104 and designed to receive the interconnecting portion 109.

In addition, at least one protection cap 120 may be also combined with the movable contact element. Said cap encloses the interconnecting portion 109 so as to protect the inner surfaces of the insulating casing 105 against the projection of particles of fused metal material produced as a result of the generation of voltaic arcs when the contacts are opened and closed.

The present invention attains the intended purposes.

The expedients proposed by the present invention in fact enable an important improvement of the operating conditions of the fixed contacts and movable contact element to be achieved, while at the same time ensuring the maintenance of an optimal electric continuity and optimal temperature distribution between the parts involved in the current flow, even in case of prolonged and heavy use of the switch. A resolutive attenuation of the effects produced by the voltaic arcs on opening and closing of the contacts is also achieved, and the casing housing the interconnecting device as a whole is capable of ensuring constant insulating characteristics over time.

Moreover, the invention enables an important saving on the production costs of the switches.

In the connection it is to be pointed out that all the above advantages have been surprisingly achieved, in contrast with the present tendencies of the known art, by reducing the silver amount joined on the interconnecting portion of the movable contact element and the second fixed contact as well as completely eliminating the silver material at the linking area between the movable contact element and first fixed contact.

Obviously, many changes and modifications may be made to the invention without departing from the scope of the appended claims.

I claim:

1. Interconnecting electrical switch structure comprising:

first and second fixed contact portions adapted electrically to be connected to first and second poles of an electric circuit;

a movable contact element having a linking portion arranged to act oscillatably on the first contact portion and also having an interconnecting portion faced toward the second fixed contact portion;

control means acting on the movable contact element to move it by angular oscillation about the linking portion between an open position where the interconnecting portion is spaced from the second fixed contact portion and a closed condition where the interconnecting portion contacts the second fixed contact portion to establish electric continuity between the first and second fixed contact portions;

the first contact portion and the linking portion mutually engaging through a sharp edge presented by one of the portions and a seating of rounded outline presented by the other of the portions with the sharp edge bearing against said seating;

the second fixed contact portion having a coupling opening with a perimetric edge extending thereabout and said interconnecting portion having a projection bounded by a conically sloping side and electric continuity being established by said conically sloping side engaging said perimetric edge.

2. The switch structure of claim 1, wherein said projection is substantially of truncated, conical form and terminates in a rounded vertex.

3. Interconnecting electrical switch structure comprising:

first and second fixed contact portions adapted electrically to be connected to first and second poles of an electric circuit;

a movable contact element having a linking portion arranged to act oscillatably on the first contact portion and also having an interconnecting portion faced toward the second fixed contact portion;

control means acting on the movable contact element to move it by angular oscillation about the linking portion between an open position where the interconnecting portion is spaced from the second fixed contact portion and a closed condition where the interconnecting portion contacts the second fixed contact portion to establish electric continuity between the first and second fixed contact portions;

the first contact portion having a substantially circular opening provided therein and the linking portion having a wedge-shaped projection with sharp edges extending along the sides thereof, and the linking portion engaging the first contact portion through said edges of said wedge-shaped projection engaging said circular opening.

4. The interconnecting electrical switch structure of claim 3, wherein the linking portion has a pair of wedge-shaped projections with each bounded by sharp edges extending along their opposite sides and wherein the fixed contact portion has a pair of circular openings.

* * * * *